United States Patent [19]

Bassili

[11] Patent Number: 5,002,196

[45] Date of Patent: Mar. 26, 1991

[54] PRESSURE VESSEL WITH REMOVABLE SEALING LID

[76] Inventor: John Bassili, 118 Swanwick Avenue, Toronto, Ontario, Canada, M4E 1Z9

[21] Appl. No.: 424,444

[22] Filed: Oct. 20, 1989

[51] Int. Cl.[5] ..... B65D 53/00

[52] U.S. Cl. ..... 220/240; 220/216; 220/222; 220/315; 220/324; 206/315.9

[58] Field of Search ..... 206/315.9; 220/240, 220/315, 318, 324, 358, 367, 216, 221, 222; 215/260

[56] References Cited

U.S. PATENT DOCUMENTS

| | | | |
|---|---|---|---|
| 658,343 | 9/1900 | Clark | 220/324 |
| 1,065,667 | 6/1913 | Donnell | 220/324 |
| 1,298,884 | 4/1919 | Chalfant | 220/324 |
| 1,910,930 | 5/1933 | Morris | 206/315.9 |
| 2,712,394 | 7/1955 | Koschatzky et al. | 206/315.9 |
| 3,233,727 | 2/1966 | Wilson | 220/367 |
| 3,415,357 | 12/1967 | Van Natter | 206/1 |
| 3,610,133 | 5/1969 | Mies, Jr. et al. | 220/324 |
| 3,688,942 | 9/1972 | Mitchell et al. | 220/324 |
| 3,800,972 | 4/1974 | Raymond | 220/324 |
| 3,853,222 | 12/1974 | Helms | 206/319.9 |
| 3,860,142 | 1/1975 | Jurges | 220/240 |
| 3,888,347 | 6/1975 | Kramer | 206/315.9 |
| 3,889,807 | 6/1975 | Feinberg | 206/315 |
| 3,897,874 | 8/1975 | Coons | 206/315.9 |
| 4,019,629 | 4/1977 | Dubner et al. | 206/315.9 |
| 4,020,948 | 5/1977 | Won | 206/315.9 |
| 4,046,491 | 9/1977 | Roeder | 417/44 |
| 4,049,949 | 9/1977 | Fitzsimons | 206/315.9 |
| 4,101,029 | 7/1978 | Feinberg et al. | 206/315.9 |
| 4,116,352 | 9/1978 | Davis | 220/240 |
| 4,124,117 | 11/1978 | Rudy | 206/213.1 |
| 4,157,146 | 6/1979 | Svenson | 220/324 |
| 4,161,247 | 7/1979 | Feinberg et al. | 206/315.9 |
| 4,270,668 | 6/1981 | Berfield | 220/324 |
| 4,428,478 | 1/1984 | Hoffman | 206/315.9 |
| 4,671,406 | 6/1987 | Baer | 206/315.9 |
| 4,729,472 | 3/1988 | Lubin et al. | 206/315.9 |

*Primary Examiner*—David T. Fidei

*Attorney, Agent, or Firm*—Rogers, Bereskin & Parr

[57] ABSTRACT

A pressure vessel having a removable lid for storing objects under pressure is disclosed. The pressure vessel includes a pressure chamber having a smooth walled opening of uniform size against which the removable lid seals with an interference fit. A stop is secured to the pressure vessel and restrains one end of the removable lid from sliding along the smooth wall. At the other end of the lid there is pivotally mounted a locking member which engages under a locking projection fixed to the pressure vessel. A lever arm, pivotally attached to the locking member, uses a levering projection (fixed to the pressure vessel) as a fulcrum to assist in fitting the lid to and removing the lid from the pressure vessel. The pressure vessel is provided with a valve for manually dumping pressure from the pressure chamber and is also provided with a source of pressurized fluid for pressurizing the chamber to a predetermined amount of pressure.

19 Claims, 4 Drawing Sheets

PRESSURE VESSEL WITH REMOVABLE SEALING LID

BACKGROUND OF THE INVENTION

The present invention relates generally to a pressure vessel having removable lid, of the type that are used for storing objects under pressure and more particularly it relates to a pressure vessel suitable for storing a large number of gas pressurized balls, such as tennis balls, under an external pressure to maintain the optimum playing characteristics of the individual balls.

Many types of pressurized balls, and in particular, tennis balls, suffer a loss of liveliness over time. More specifically, tennis balls are packaged under pressure at the factory in hermetically sealed containers. It is necessary to break the seal and release the pressure from the container before play can commence with the tennis balls. This results in the tennis balls having a greater pressure inside than outside which pressure gradually equalizes with ambient air over time. Depending upon the degree of pressure loss, the performance characteristics of the ball deteriorate to the point that the ball is unfit for play. What is desired is a pressurized environment which reduces or eliminates the tendency of the tennis balls to lose pressure over time, at least while subject to the pressurized environment.

Many attempts have been made to provide a resealable container which is capable of maintaining tennis balls under pressure. Some examples of such devices are disclosed in the following U.S. Pat. Nos. 3,415,357; 3,853,222; 3,888,347; 3,889,807; 3,897,874; 4,019,629; 4,020,948; 4,101,029; 4,124,117 and 4,161,247.

These devices rely on both gas pressurization or mechanical pressing of bellows or the like. Some have been proposed for use in associatron with a limited number of balls, typically three. However, what is desired is a pressure vessel which can accommodate more than three balls.

An example of a larger multi-ball storage device is found in U.S. Pat. No. 4,101,029. However, this patent discloses a pressure vessel with a center post and a sealing ring which combine to make the use of the device very awkward. For example, to remove the lid requires first that the pressure be released, then the cover assembly must be depressed against a spring on the center post, then the seal must be pulled away from the rim of the lid, then the center post may be raised again, then the handle at the top of the center post must be unscrewed, then the lid may be removed. The only way balls can be removed from the container is to remove the lid. In the unassembled position, there are three separate components apart from the pressure vessel itself, namely the seal, the lid, and the handle. Any of these components may be lost or misplaced which is undesirable. Further, the number of steps involved in removing and repositioning the lid make this device awkward and difficult to use.

SUMMARY OF THE PRESENT INVENTION

What is desired is a device which has a removable lid which contains an integral seal which forms a tight pressure resistant seal. It is also desired that such lid be easily fitted to and removed from the pressure chamber. What is also desired is a lid which can be removed without the necessity of depressing the same nor unscrewing a handle to obtain its release from the pressure vessel. Further, what is desired is a pressure vessel which has enough capacity to accommodate a large number of balls and yet which is made from standard easy to obtain materials and hence is inexpensive and easy to manufacture.

According to the present invention there is provided a pressure vessel having a removable lid for storing objects under pressure, said pressure vessel comprising:

a pressure chamber having a smooth walled opening of uniform size, said removable lid closing said opening and carrying an integral seal, said seal being dimensioned to form an interference fit with said smooth wall to seal there against, said removable lid being readily fitted to and removed from said opening by reason of said opening's uniform size, restraining means to selectively restrain said removable lid from sliding along said smooth walled opening when said pressure chamber is pressurized, a valve mounted in said pressure chamber for dumping pressure from said chamber when said chamber is pressurized, and a source of pressurized fluid for pressurizing said chamber to a predetermined amount of pressure.

BRIEF DESCRIPTION OF THE DRAWINGS

By way of example only, reference will now be made to a preferred embodiment of the invention by reference to the following drawings in which.

DESCRIPTION OF THE PREFERRED EMBODIMENTS

Figure 1:
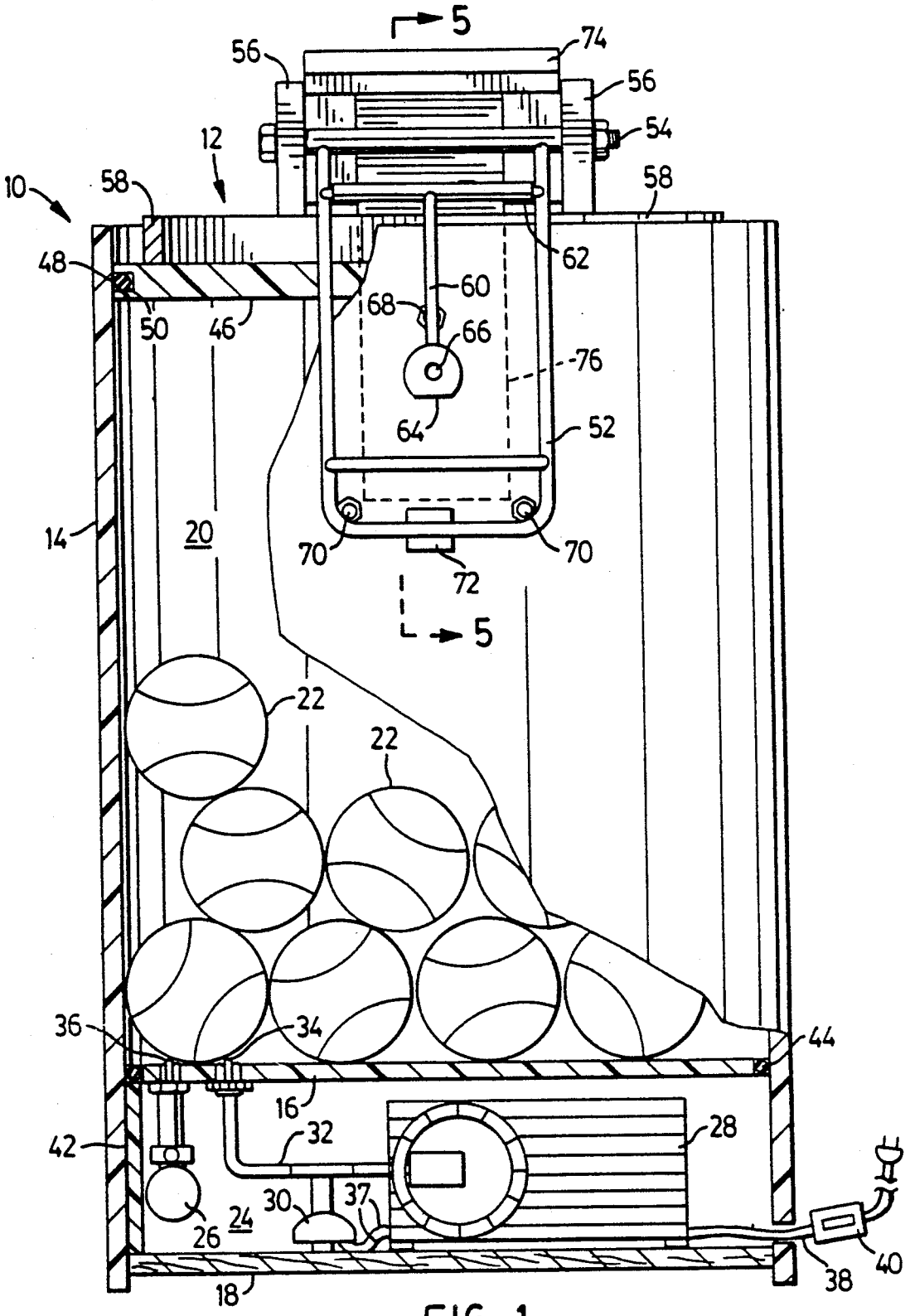
FIG. 1 is a side view in part section of a pressure vessel according to one embodiment of the present invention.

Referring now to the drawings, and in particular FIG. 1, there is illustrated a preferred embodiment of the invention in which reference numeral 10 generally denotes the pressure vessel which comprises a removable lid 12, a tubular body 14, a pressure-bulkhead 16, and a bottom wall 18. A pressure chamber 20 is formed between the removable lid 12, tubular body 14, and a pressure-bulkhead 16. A number of balls 22 are shown in the pressure chamber 20. An equipment chamber 24 is formed between the pressure-bulkhead 16 and the bottom wall 18.

The equipment stored in the equipment chamber 24 include a safety release valve 26, a compressor 28 and a pressure switch 30. The pressure switch 30 is connected with the compressor 28 by means of a pressure line 32 having an exit orifice 34 into the pressure chamber 20. The safety release valve 26 has an exit orifice 36 into the pressure chamber 20.

Also shown are electrical leads 37 which electrically connect the pressure switch 30 to the compressor. A power supply cord 38 is also shown with an on-off switch 40. It will be appreciated that the power source could either be a 12 volt plug suitable for being powered for example by a car battery or standard household current supply depending upon the circuit design of the compressor 28. A description of the pressurization of the pressure vessel 10 is described in detail below.

For the purpose of structural integrity, the bottom wall 18 is preferably securely fastened to the tubular body 14 by means of screws or the like. The compressor 28 can also be then securely screwed to the bottom wall 18. It has been found that satisfactory results are achieved when the bottom wall 18 is formed from wood although other suitable materials may be used.

The tubular body 14 is preferably made out of PVC tubing. It has been found that satisfactory results can be achieved with twelve inch diameter standard PVC pipe, although it will be appreciated by those skilled in the art that other diameters of pipe may also be suitable.

As shown in FIG. 1, the pressure-bulkhead 16 is supported in place by reinforcing strips 42. The reinforcing strips 42 are preferably pieces of PVC which have been solvent welded to the inner wall of the equipment chamber 24. Three or four of these strips 42, evenly spaced about the circumference of the tubular body 14 are desirable to provide satisfactory support.

It will be appreciated by those skilled in the art that other equally satisfactory ways of supporting the pressure-bulkhead 16 may be devised, although good results have been achieved through the use of the reinforcing strips 42 because of their strength and simplicity of construction.

The pressure-bulkhead 16 is shown having an o-ring 44 placed in a groove around its periphery. In the embodiment shown in FIG. 1, pressure in the pressure chamber 20 would cause a downward force on the pressure-bulkhead 16 causing it to seat firmly against reinforcing strips 42. However, rather than o-ring 44 where the pressure-bulkhead 16 is also made from PVC, it would be possible to solvent weld the pressure-bulkhead 16 around its periphery to the inner wall of the tubular body 14. Either method would yield satisfactory results, although use of the o-ring is slightly preferred. With a properly dimensioned o-ring a pressure tight seal is easily obtained. With solvent welding it can be more difficult to ensure that a pressure tight seal is formed.

The resealable lid 12 includes a flat disk 46 having an o-ring 48 placed in a groove 50 about its outer edge. A locking member 52 is pivotally attached to the top of the removable lid by means of a bolt 54 which is supported between brackets 56. The brackets 56 are in turn supported on a reinforcing structure 58. A lever arm 60 is pivotally mounted at 62. At the end of lever arm 60 is a thrust surface 64 and recess 66.

While reference is made both in the description and the drawings to the removable lid 12 being formed of a flat disk 46, it is also possible that other shaped lids could be employed. With the flat disk 46, it is desirable to provide a reinforcing structure 58, to prevent the disk 46 from deforming under pressure. Such deformation could cause the loss of sealing action around the periphery. However, disk 12 could also be hemispherical shaped, which those skilled in the art will appreciate, is a preferable structure for retaining pressure. For example, the lid 12 could be moulded from a rigid plastic to form the hemispherical shape.

Attached to the tubular body 14 of the pressure vessel 10 are various components which interact with the removable lid 12. In the preferred embodiment illustrated in FIG. 1 there is a levering projection 68 which is partially hidden behind lever arm 60. Also shown are locking projections 70 as well as a magnet 72. On the opposite side of the tubular body 14 is shown a stop 74 mounted on a mounting member 76 (shown in part ghost outline). The stop 74 is angled slightly to form a notch on its underside.

Figure 2:
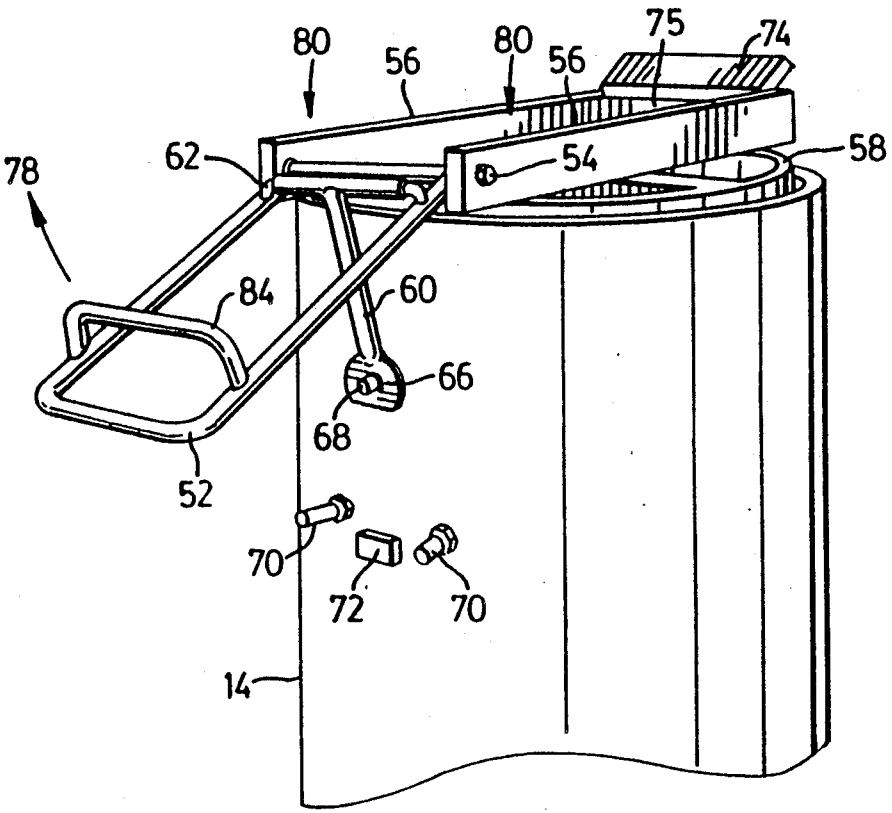
FIG. 2 is a perspective view of the pressure vessel of FIG. 1 showing a removable lid being fitted to the pressure vessel.

Referring to FIG. 2 it can now be appreciated how the removable lid 12 of the present invention functions in the preferred embodiment. Because it is necessary to maintain a tight pressure seal, o-ring 48 is somewhat oversized compared to the internal diameter of the tubular body portion 14. By reason of this over-sizing, an interference fit is created such that a good pressure seal is obtained between the o-ring 48 and the inside wall of the tubular body 14. However, this can make it difficult to manually insert the removable lid 12 into the bore of the tubular body 14 to form the pressure chamber 20. Therefore, the lever arm 60 is provided which assists in placing the removable lid 12 in position.

In FIG. 2, there can be seen end member 75 which joins the ends of brackets 56 distant from the pivotally mounted locking member 52 and which fits under stop 74 in the notch. The end member 75 is not attached to, but merely abuts underneath the stop 74. This is believed desirable, because under the influence of pressure the end member 75 rides up into engagement with the underside of stop 74. However, it would also be possible to use a sliding hinge to allow the same movement, while at the same time hinging the lid 12 to the body 14 which in some cases may also be desirable.

The lever arm 60 is shown having the recess 66 penetrated by the levering projection 68. As the lever arm 60 is pivotally mounted to the locking member 52, by raising the outer end of locking member 52 as shown by arrow 78 the removable lid 12 is forced downwardly as indicated by arrows 80 into the tubular body 14. As the pivotal mounting point 62 of the lever arm 60 is closely adjacent to the removable lid 12, a great deal of downward force in the direction of arrows 80 is generated by relatively modest upward force at arrow 78. By reason of the stop 74 at one end of the lid and the lever arm 60 at the other end, the removable lid 12 is slid down the smooth walls of the tubular body 14 to form an air tight seal there against. Even though seal 48 forms an interference fit, the leverage provided by lever arm 60 and locking member 52 ensures the simple easy positioning of the lid 12 in the body 14.

Figure 3:
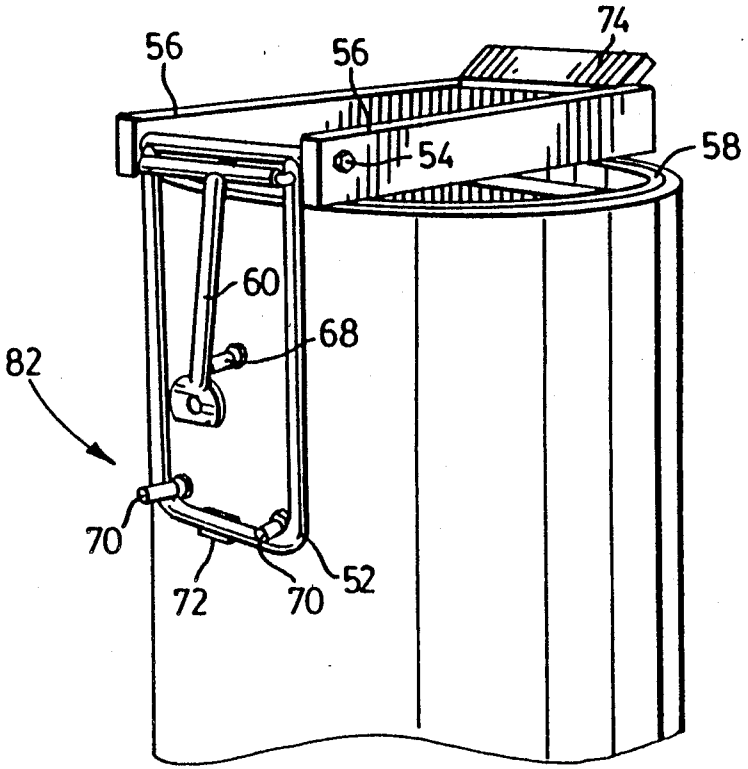
FIG. 3 is the pressure vessel of FIG. 2 showing the removable lid being locked in place.

Then, as shown in FIG. 3, the levering projection 68 is disengaged from the recess 66 on the lever arm 60 and the locking arm 52 is rotated downwardly in the direction of arrow 82 until it is nestled underneath locking projections 70 against magnet 72. Forming a part of the locking member 52 in FIG. 2 is a handle element 84 which provides an easy place to grasp the lever 52. However, the gripping lever 84 is not essential, and consequently is not shown in FIG. 3.

When the removable lid 12 is in the position as illustrated in FIG. 3, the pressure chamber 20 may be pressurized. Pressurization is achieved by supplying power to the compressor 28 through the electrical power supply cord at 38. The compressor 28 feeds fluid under pressure, preferably air, through line 32 out orifice 34 into pressure chamber 20. Upon attaining the desired pressure level, the pressure sensor switch 30 deactivates the compressor 28. It has been found that good pressurization of tennis balls can be achieved where the pressure switch 30 is set to 14 PSI. The safety release valve 26 is simply to ensure that in the event of a malfunction of pressure switch 30, the pressure vessel is not over pressurized. Thus, the safety release valve 26 may be set to any suitable number greater than 14 PSI, for example 16 PSI. The pressure switch 30 is preferably of the type that will cause the compressor 28 to turn on again should the pressure in the pressure chamber 20 slip below the desired level of 14 PSI in the known manner.

Figure 5:
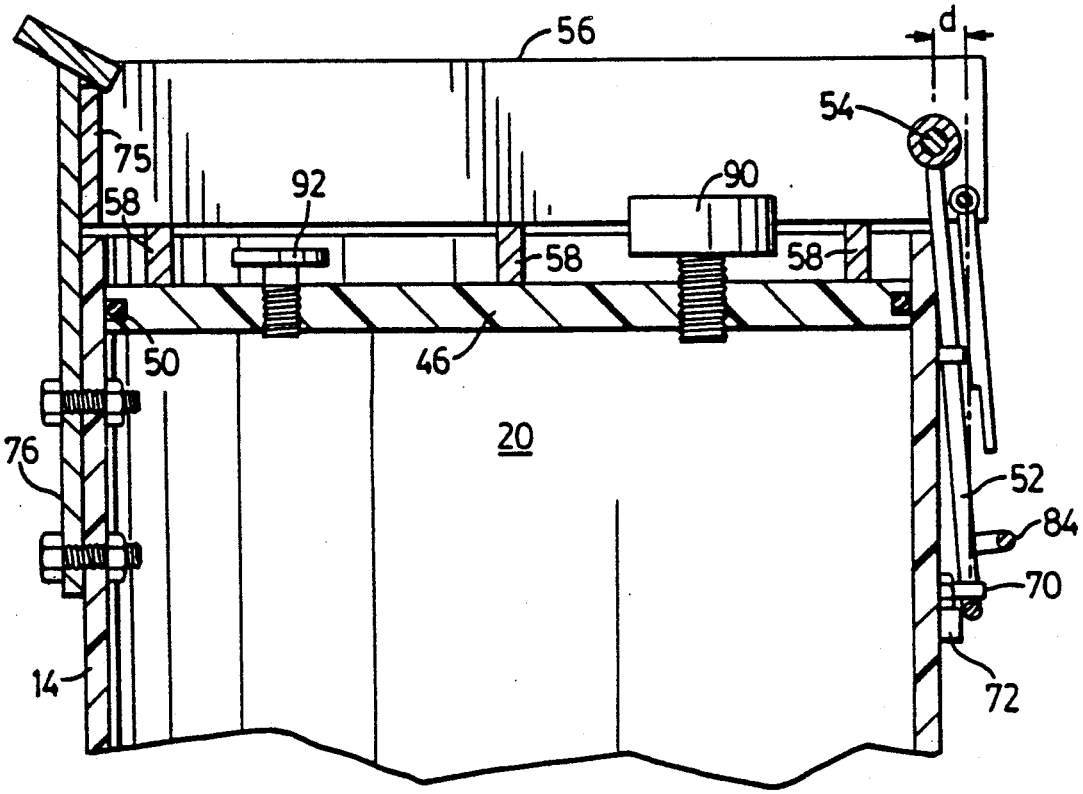
FIG. 5 is a cross-sectional view along lines 5—5 of FIG. 1.

FIG. 5 shows, in a cross-sectional view through the removable lid 12, various additional components. In particular, there is shown a pressure gauge 90 and a manually operable pressure release valve 92. The pressure gauge 90 is preferably of the dial type and will provide a reading of the pressure within the pressure chamber 20. The pressure dial 90 is not essential but it is useful in order to ensure that the compressor 28 and pressure switch 30 are functioning as intended. The manually operable pressure relief valve 92 provides a way to dump pressure from the pressure chamber 20 when it is desired to open the pressure vessel 10 to remove the contents.

Under the influence of the pressure in the pressure chamber 20, the locking member 52 is securely locked underneath locking projections 70. By reason of the bolt 54 being laterally displaced towards the centre of the tubular body 14 a distance (d) as shown, there is a vectorial component of the tensile force in the locking member 52 keeping the locking member 52 securely seated over the locking projections 70. In this manner, accidental release of the removable lid 12 while still under pressure is virtually eliminated.

It will be appreciated by those skilled in the art that other safety features could be incorporated into the locking member 52. For example, grooves could be formed on the underside of the locking projections 70, to mate with the locking member 52. This would provide an additional locking action. Alternatively, locking projections 70 could be made slightly longer. Since the removable lid 12 may slide upwardly slightly upon the pressure chamber 20 being pressurized, to unhook the locking member from longer projection 70 would require the lid 12 be lowered, against the pressure, to disengage it from the projection 70. This would require a tremendous amount of force. Thus longer locking projections 70 would also increase the safety of the device.

So, under the influence of pressure in the pressure chamber 20 the stop 74 acts at one end of the removable lid 12 to retain it in place and the locking member 52 acts at the other end to retain the removable lid 12 in place. These, in combination, act as a means of restraining removable lid 12 to restrain the same from moving along the smooth walls when the pressure chamber 20 is pressurized. By reason of being fixed at these two points, the removable lid 12 stays in place while maintaining a tight seal against the pressure in pressure chamber 20. It will be appreciated therefore, upon pressurization, the removable lid 12 rides up the smooth walls slightly to attain the locked position described above.

Figure 4:
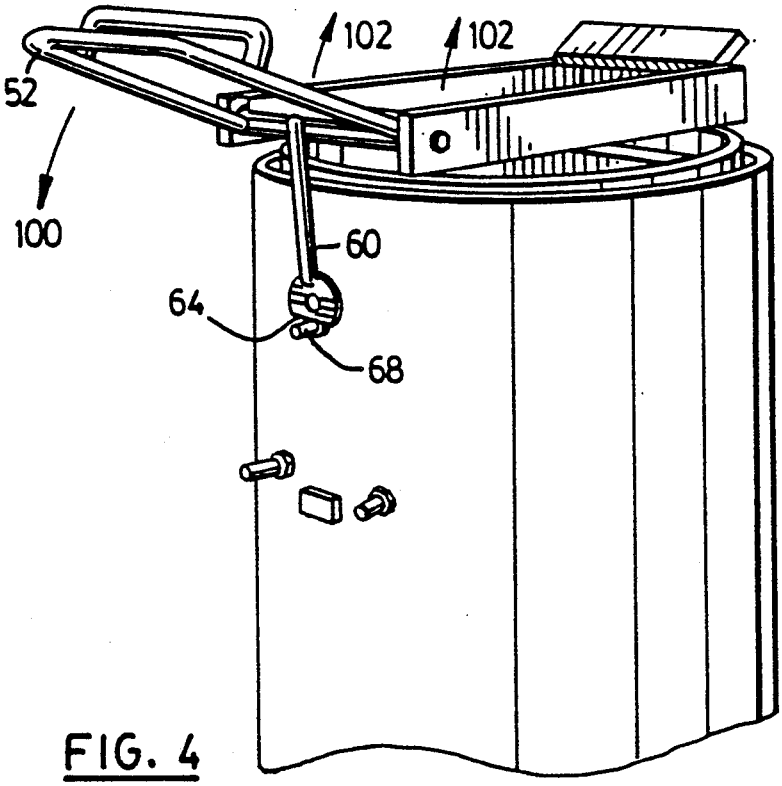
FIG. 4 is the pressure vessel of FIGS. 2 and 3 showing the removable lid being removed.

When it is desired to release the pressure, pressure relief valve 92 or drain cock 92 is released thereby allowing the pressure to escape. This eliminates the force retaining locking member 52 under locking projections 70 thereby enabling it to be easily withdrawn by pulling on handle 84. However, by reason of the interference fit between the removable lid 12 and the tubular body 14 it can be difficult to remove the lid 12 from the body 14. However, as shown in FIG. 4, the lever arm 60 can again be used. By placing the end of lever arm 60 and in particular the thrust surface 64 on top of the levering projection 68 a fulcrum can be made. Then pulling the locking member 52 downward in the direction of arrow 100 will cause the removable lid 12 to be raised in the direction of arrows 102. By fully swinging locking member 52 down, the removable lid is disengaged from the tubular body 14 and thus can be easily lifted off of the body 14.

It will be appreciated by those skilled in the art that locking projections 70 and levering projection 68, together with bolts for support member 76 all penetrate the side wall of the tubular body 14. It is necessary to ensure that such penetrations remain pressure tight, and consequently, it is necessary to seal these with liquid rubber or the like in a known manner. It has been found that the projections 68 and 70 can be readily formed from standard bolts, which are threaded through the body 14, in the known manner.

It can now be appreciated that the present invention, with reference to the preferred embodiment described above, provides a resealable pressure vessel with an easily removable lid. By reason of the pivoting locking member 52 and the levering arm 60, the interference fit of the removable lid 12 which provides a good seal but which also acts as an impediment to the easy placement of the removable lid 12 in the tubular body 14 does not impede the easy fitting and removal of the lid 12. Balls can be easily loaded into the pressure vessel which can then be easily sealed. The pressure in the chamber 20 secures the lid 12 in place. Conversely, upon release of the pressure through the manually actuable relief valve 92 the removable lid 12 can easily be levered out of engagement with the tubular body 14 and removed. In this manner, the balls may easily be dumped out of the pressure vessel and used.

It will also be appreciated that by varying the length of the tubular vessel, different numbers of balls can be accommodated. As the preferred building material for the tubular body is standard PVC pipe, the height of the pressure vessel can be varied to any appropriate length.

Figure 6:
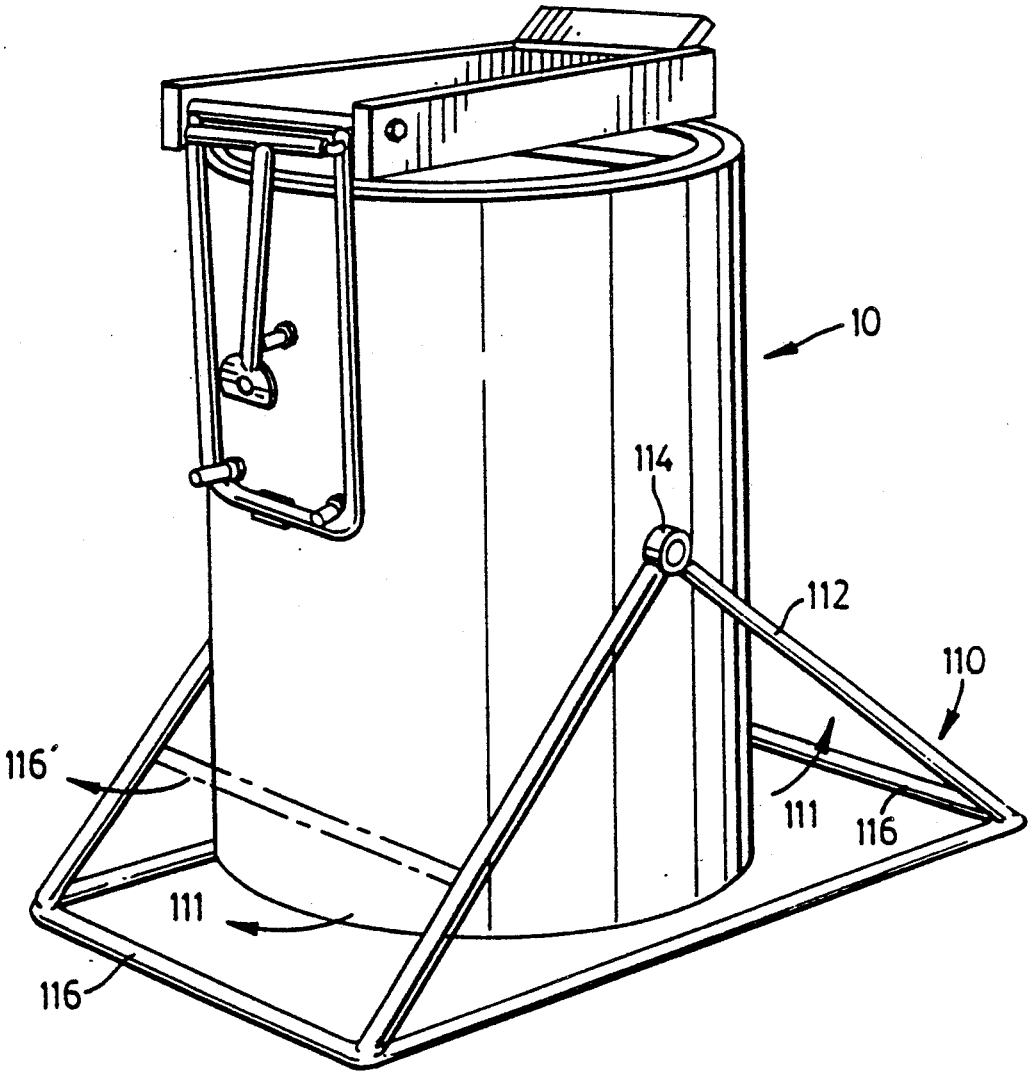
FIG. 6 is a view showing the pressure vessel of FIG. 1 mounted on a stand.

FIG. 6 shows the pressure vessel 10 mounted on a pivoting stand denoted as 110. The purpose of the stand is to raise the pressure vessel 10 above the ground, so it may be easily tipped to unload tennis balls (as denoted by arrows 111). The stand 110 is formed of two generally triangular members 112 having apexes 114. The apexes 114 are pivotally attached to the pressure vessel 110, by, for example, a bolt or the like. Also shown are crossbars 116.

Although the crossbars 116 are shown on the plane of the ground they could also be raised, in which case they would act as a means to prevent unwanted pivoting of the pressure vessel 10 (shown in ghost outline as 116). Further, the pressure vessel 10 could be positioned at any convenient height.

It will be appreciated by those skilled in the art that the above description of the preferred embodiment is one application of the invention and is not necessarily the only application. For example, there may be other situations where pressure vessels are needed, and where access to the pressure vessel is desired. In any case where a pressure vessel is required with an easily removable lid, the instant invention will have application. In addition, it will be apparent to those skilled in the art that there may be certain variations to the invention which do not depart from the broad scope of the invention. Some of these have been suggested above, and others will be apparent. However, such variations do not depart from the broad scope of this instant invention.

The Embodiments of the Invention in which an exclusive property or privilege is claimed are defined as follows:

1. A pressure vessel for storing objects under pressure, said pressure vessel comprising:

a pressure chamber having an opening, a removable lid closing said opening, a floating radial pressure seal between said removable lid and said opening, said removable lid floating with respect to said opening and thereby;

external restraining means acting between the floating removable lid and the pressure vessel;

a valve mounted in said pressure chamber for dumping pressure from said chamber when said chamber is pressurized; and a source of pressurized fluid for pressurizing said chamber to a predetermined amount of pressure, wherein upon said pressure chamber being pressurized said floating removable lid floats within said opening, said pressure causing said lid to clamp against said external restraining means to prevent accidental release of pressure without axially compressing the pressure seal, said lid only being releasable from said clamping upon release of the pressure from the pressur chamber.

2. A pressure vessel as claimed in claim 1 wherein said restraining means further comprises a stop, and at least one locking projection mounted on generally opposite sides of said pressure vessel, and said removable lid further includes a locking member pivotally mounted to said lid for locking onto said locking projection.

3. A pressure vessel as claimed in claim 2 wherein said locking member further includes a lever arm pivotally mounted on said locking member and said pressure vessel further includes a levering projection.

4. A pressure vessel as claimed in claim 2 further including two locking projections, and wherein said locking member is generally rectangular for locking onto both said locking projections.

5. A pressure vessel as claimed in claim 4 wherein said locking member further includes a handle member.

6. A pressure vessel as claimed in claim 3 wherein said lever are further includes a recess to secure the lever arm over the levering projection to assist drawing the lid into the openeing and a thrust surface to position on the levering projection to assist drawing the lid out of the opening.

7. A pressure vessel having a removable lid for storing objects under pressure, said pressure vessel comprising:

a pressure chamber having a straight walled opening, said removable lid closing said opening and having an integral radial seal, said seal being dimensioned to form an interference fit with said straight wall to form a pressure resistent seal there against;

a stop mounted on said pressure vessel for restraining movement of one side of said lid;

a locking member pivotally mounted on the other side of said likd, at least one locking projection mounted on said pressure vessel for locking said locking member;

a valve mounted in said pressure chamber for dumping pressure from said chamber when said chamber is pressurized; and a source of pressured fluid for pressurizing said chamber to a predetermined amount of pressure upon said pressure vessel being pressurized said removable lid clamping against said stop and said locking member without axially compressing said radial seal, said lid not being free to unclamp until the pressure is released from the chamber.

8. The pressure vessel of claim 7 wherein said locking member is pivotally mounted at a point laterally displaced from said locking projection whereby, when said pressure vessel is pressurized, a force component is generated tending to keep said locking member on said locking projection.

9. The pressure vessel of claim 7 or 8 further including a pivoting lever arm mounted between said locking member and said pressure chamber, said lever arm providing leverage to facilitate the fitting and removal of the removable lid to the opening.

10. The pressure vessel of claim 7 or 8 wherein said locking member further includes a lever arm pivotally mounted thereon, and a levering projection mounted on the pressure chamber to act as a fulcrum.

11. The pressure vessel of claim 7 or 8 wherein said locking member further includes a lever arm pivotally mounted thereon, and a levering projection mounted on the pressure chamber to act as a fulcrum, and wherein said lever arm further includes a recess to secure the lever arm over the levering projection to assist drawing the lid into the opening and a thrust surface to position on the levering projection to assist drawing the lid out of the opening.

12. The pressure vessel of claim 7 or 8 wherein said locking member further includes a lever arm pivotally mounted thereon at a second pivotal mounting point closer to the pivotal mounting point of said locking member than said locking member's free end, and a levering projection mounted on the pressure chamber to act as a fulcrum.

13. The pressure vessel of claim 7 or 8 wherein said locking member further includes a lever arm pivotally mounted thereon, and a levering projection mounted on the pressure chamber to act as a fulcrum, said lever arm being mounted at a second pivotal mounting point which is generally above said locking projection.

14. The pressure vessel of claim 1 or 7 wherein said pressurized fluid used is air and wherein said source of pressurized fluid is a compressor.

15. The pressure vessel of claim 1 or 7 wherein said pressurized fluid used is air and wherein said source of pressurized fluid is a compressor, and further includes a pressure switch connected in series with said compressor.

16. The pressure vessel of claim 1 or 7 further including a safety release valve.

17. The pressure vessel of claim 1 or 7 further including a visible pressure gauge.

18. The pressure vessel of claim 1 or 7 further including an equipment chamber.

19. A pressures vessel having a removable lid for storing objects under pressure, said pressure vessel comprising:

a cylindrical pressure chamber of uniform diameter along its axis having a cylindrically walled opening, said removable lid closing said opening and carrying an integral radial pressure seal, said seal being dimensioned to form an interference fit with said cylindrical wall to seal there against said removable lid being free floating with respect to said cylindrically walled opening;

locking means to lock said removable lid from sliding along said cylindrical wall under the influence of pressure when said pressure chamber is pressurizd;

a valve mounted in said pressure chamber for dumping pressure from said chamber when said chamber is pressurized;

a source of pressurized fluid for pressurizing said chamber to a predetermined amount of pressure;

said removable lid sliding along said cylindrical wall when said pressure chamber is pressurized and engaging said locking means to secure the removable lid in place without axially compressing the pressure seal said lid not being disengagable from said locking menas until the pressure is released from said pressure chamber, whereby the accidental release of the pressure is prevented.

* * * * *